US012029326B2

(12) United States Patent
Vetter

(10) Patent No.: US 12,029,326 B2
(45) Date of Patent: Jul. 9, 2024

(54) MATTRESS HAVING A MULTIPLICITY OF ELASTIC ELEVATIONS

(71) Applicant: Kubivent Sitz- und Liegepolster GmbH, Urbach (DE)

(72) Inventor: Susanne Vetter, Stuttgart (DE)

(73) Assignee: Kubivent Sitz- und Liegepolster GmbH, Urbach (DE)

( * ) Notice: Subject to any disclaimer, the term of this patent is extended or adjusted under 35 U.S.C. 154(b) by 243 days.

(21) Appl. No.: 17/297,137

(22) PCT Filed: Nov. 26, 2019

(86) PCT No.: PCT/EP2019/082592
§ 371 (c)(1),
(2) Date: May 26, 2021

(87) PCT Pub. No.: WO2020/109306
PCT Pub. Date: Jun. 4, 2020

(65) Prior Publication Data

US 2022/0015549 A1 Jan. 20, 2022

(30) Foreign Application Priority Data

Nov. 28, 2018 (DE) ..... 102018220431.4

(51) Int. Cl.
*A47C 27/14* (2006.01)

(52) U.S. Cl.
CPC ..... *A47C 27/146* (2013.01)

(58) Field of Classification Search
CPC ..... A47C 27/146
USPC ..... 5/722
See application file for complete search history.

(56) References Cited

U.S. PATENT DOCUMENTS 4,110,881 A * 9/1978 Thompson ..... A47C 27/146 5/730
4,768,251 A 9/1988 Baskent
4,809,374 A * 3/1989 Saviez ..... A47C 27/146 5/944
5,353,455 A * 10/1994 Loving ..... A47C 23/002 29/451
5,452,488 A * 9/1995 Reinhardt ..... A47C 27/14 5/944
2010/0005594 A1* 1/2010 Rancourt ..... A47C 27/144 5/655.5
2018/0280216 A1* 10/2018 Mascull ..... F16B 1/00
(Continued)

FOREIGN PATENT DOCUMENTS

DE 1554130 A1 11/1969
DE 3209868 A1 9/1983
(Continued)

*Primary Examiner* — Myles A Throop
(74) *Attorney, Agent, or Firm* — Duane Morris LLP

(57) ABSTRACT

The invention relates to a mattress comprising at least one layer (31) having a multiplicity of elastic elevations. Said elastic elevations together form at least one supporting surface for the user of the mattress.

Figure 1:
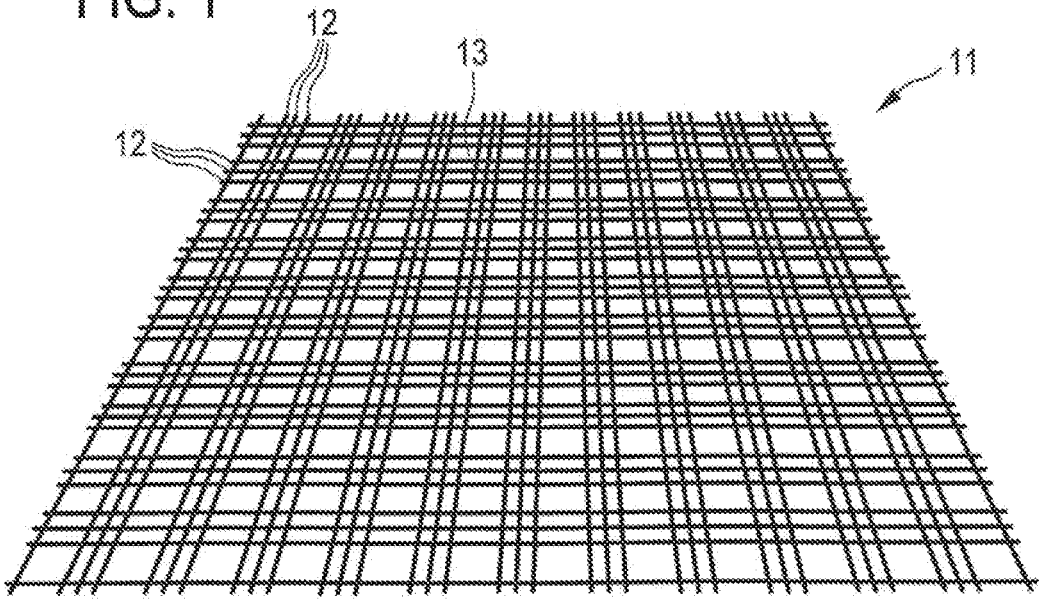

According to the invention, the elastic elevations are designed, or arranged, such that an uneven supporting surface is formed.

At least two types of elastic elevations with different elasticity are preferably provided. The elastic elevations are formed in particular on elastic bodies (21, 22, 23, 24), wherein each elastic elevation can be formed on a respective elastic body.

17 Claims, 4 Drawing Sheets

(56) References Cited

U.S. PATENT DOCUMENTS

| | | | | |
|---|---|---|---|---|
| 2018/0317665 | A1* | 11/2018 | Mascull | A47C 7/36 |
| 2019/0307622 | A1* | 10/2019 | Langer | A61G 7/05723 |
| 2021/0120957 | A1* | 4/2021 | Amiri | B68G 13/00 |

FOREIGN PATENT DOCUMENTS

| | | | |
|---|---|---|---|
| DE | 29701959 | U1 | 9/1997 |
| DE | 202015106930 | U1 | 1/2016 |
| EP | 2781209 | A1 | 9/2014 |

* cited by examiner

MATTRESS HAVING A MULTIPLICITY OF ELASTIC ELEVATIONS

PRIORITY CLAIM AND CROSS REFERENCE

The present application is a National Stage Application, filed under 35 U.S.C. 371, of International Patent Application No. PCT/EP2019/082592, filed on Nov. 26, 2019 and published as WO 2020/109306, which claims the priority of German Patent Application No. DE 102018220431.4, filed on Nov. 28, 2018, each of which is incorporated here by reference in entirety.

The invention relates to a mattress comprising at least one layer having a multiplicity of elastic elevations. Said elastic elevations together form at least one supporting surface for the user of the mattress.

There are a large variety of variants of mattresses which are generally manufactured from foam plastics in the prior art. Here, embodiments have also been disclosed in which the supporting surface is formed from smaller partial surfaces which are for example provided by individual foam elements.

For example, DE-OS 1554130 discloses a mattress (base or support for the human body), in the case of which foam or foam rubber portions are inserted into a grid-like carrier. Those parts of said portions which protrude beyond said carrier then together form the supporting surface of the mattress.

DE 29701959 U1 discloses a mattress, in the case of which contiguous cube elements are formed from a supporting layer by way of cutting. Said cube elements are rounded in a pyramid-shaped manner on their upper side.

The applicant's document EP-A1-2781209 describes a mattress, in the case of which individual elastic bodies, preferably of cube or cuboid shape, are inserted into the open meshes of a grid. Located above said actual supporting surface is a further single-layer foam support having a thickness of less than 5 cm and a compression hardness <4 kPa.

All of the cited prior art mattresses have the common factor that the user of the mattress is provided with an ultimately even supporting surface. Thus, the aspect that is of paramount importance is that the mattress should make it possible to rest on the supporting surface with the greatest possible comfort.

By contrast, the present invention prioritizes a completely different aspect than the prior art. It should not primarily be a matter of making it possible to rest and lie on the mattress in a comfortable and ideally also orthopedically healthy manner. Rather, human evolution should be taken into account in the development of a novel mattress. It is thus a question of: Which of people's resting or lying positions actually correspond to their physical needs? Which resting and lying positions are actually "species-appropriate" and "healthy"?

Correspondingly, the invention intends to provide a mattress which makes it possible for people to rest or sleep in a manner that is actually relaxed. In this case, the actual supporting surface of the mattress is intended to also take account of human evolution, and it is thus intended to be made possible for original lying positions that have been forgotten over long periods of time to be able to be assumed on the mattress. By way of example, the novel mattress should make it possible to (again) give the user the feeling of resting or sleeping on a soft forest floor.

At least said objects are achieved by the mattress having the features of claim 1 and the layer having the features of claim 14. Preferred embodiments of said mattress and said layer are described in dependent claims 2 to 13 and 15 and 16, respectively.

The wording of all of the claims is hereby incorporated expressly into the content of this description by reference.

The novel mattress comprises at least one layer having a multiplicity of elastic elevations. Said elastic elevations together form at least one supporting surface for at least one part of the body of a user of the mattress.

According to the invention, the elastic elevations are designed, or arranged, such that an uneven supporting surface is formed.

According to the invention, the term "mattress" is intended to encompass all padding and padding elements that are provided in fundamentally any desired size as a support or base, in particular for the human body or a part thereof, for example for lying or sitting purposes.

According to the invention, the expression "elastic elevation" is intended to mean that individual portions or regions having an elasticity are provided, which correspondingly deform under the action of force (lying down of the body) and, after said force has been removed, return to the original shape. A multiplicity of such elastic portions or regions then together form the supporting surface of the mattress.

These aspects of the invention will be explained in more detail below.

As already mentioned, a crucial factor in the case of the invention is that an uneven supporting surface is formed by means of the elastic elevations. In this case, "uneven" is intended to mean that different points/regions of the supporting surface have different heights, in contrast to an even supporting surface. Preferably, the unevenness in the case of the invention does not follow any regular pattern, rather the points/regions of differing height are distributed in an irregular manner over the supporting surface.

The uneven supporting surface can on the one hand be provided by way of a corresponding configuration of the corresponding elastic portions and regions. For instance, it is for example possible for elevations with different heights to be provided.

However, an uneven supporting surface can for example also be provided by arranging elevations differently in order to form the layer. These two different aspects will likewise be explained below.

In preferred embodiments of the mattress according to the invention, at least two types of elastic elevations with different elasticity are provided. In this way, it is possible to achieve a situation whereby a different hardness of the supporting surface is provided in different regions of the uneven supporting surface. In other words: in these preferred embodiments, the supporting surface provided by the elastic elevations is not only uneven but also varies in terms of elasticity/hardness.

As will be explained later, the elastic elevations/portions/regions can be formed in different ways on the layer of the mattress. However, according to the invention, it is preferable for the elastic elevations to be formed on elastic bodies, in particular individual elastic bodies. In this case, each elastic body preferably provides an elastic elevation.

As is shown below, in the case of a cuboidal or cube-shaped elastic body, it is for example possible for the elastic elevation to be formed by (at least) one side surface of said cuboid/cube.

In principle, the elastic elevations, and in particular also the elastic bodies on which the elastic elevations are formed, can be composed of a wide variety of natural or artificially produced materials. In this case, it is preferable for plastics, in particular foam plastics, to be used, particular preference being given to using at least one polyurethane foam in this context.

In the case of foam plastics, a distinction is made, inter alia, between hard foam plastics and soft foam plastics. As is well known, hard foam plastics are foams which oppose a deformation under compressive loading with a relatively high resistance. This can be attributed, inter alia, to the fact that hard foams are predominantly closed cell. By contrast, the (softer) soft foam plastics generally have an open cell structure. If, according to the invention, the intention is to use hard foam plastics, mention may be made here, in particular, of polyurethane (PUR/PIR) foams or polystyrene (PS) foams.

In the case of the soft foam plastics which may be used with preference according to the invention, use is made in particular of polyurethane (PUR) foams. As is well known, said polyurethane foams are produced from isocyanates and polyether polyols, with open cell crosslinking. Here, polyurethane (PUR) composite foams may also be concerned, which are generally composed of cutting remains from the production of PUR soft foam and of at least one binder.

All plastics, in particular foam plastics, which may be used according to the invention are readily known to the person skilled in the art, in particular also in conjunction with the production of mattresses.

In one development, in order to form the uneven supporting surface of the mattress, the elastic bodies with the elastic elevations have different dimensions. It is thus possible for the elastic bodies, in particular the polyhedra described below, to have different heights. By means of said different dimensions, in particular different heights, it is then possible to provide an uneven supporting surface.

In the last-mentioned embodiments, it is preferable for there to be a comparatively small number of types of elastic bodies with different dimensions. It is for example possible to provide fewer than ten, in particular fewer than five, and preferably (only) two types of elastic bodies with different dimensions in order to form the uneven supporting surface. The supporting surface overall is then composed only of two types of elastic bodies with different dimensions, wherein it is optionally and preferably possible for said different elastic bodies to also have a different elasticity.

This aspect of the invention will also be explained in more detail below.

As already indicated, according to the invention, the elastic bodies preferably have the shape of a polyhedron. As is well known, a polyhedron is a body which is bounded exclusively by straight surfaces (planes). In the case of the invention, as will be explained in more detail later, said straight surfaces (planes) can serve as elastic elevation in order to provide a corresponding portion or region for the uneven supporting surface.

In particular, in the invention, the elastic bodies have the shape of a cuboid or of a cube.

According to the invention, the elastic bodies preferably have dimensions (edge lengths in the case of polyhedra) of less than 20 cm, wherein preference is given to dimensions between 1 cm and 15 cm. Within the last-mentioned range, further preference is given to dimensions between 2 cm and 10 cm, in particular between 5 cm and 8 cm.

In the case of an elastic body of cuboid shape having the edge lengths a and b, which define the base area of the cuboid, and the edge length c, which defines the height of the cuboid, the dimensions a and b preferably lie between 5 cm and 7 cm, and the dimension c lies between 3 cm and 8 cm.

If, in the case of cuboidal elastic bodies, as described above, use is for example made according to the invention of two types of elastic bodies with different dimensions, the edge lengths a, b and c for said two elastic bodies can be in particular a=b=c=5 cm or a=b=5 cm and c=6 cm. In a further preferred combination of elastic bodies with different dimensions, said dimensions are a=b=5 cm and c=6 cm or a=b=5 cm and c=8 cm.

From said aforementioned dual combinations of cuboidal elastic bodies with different dimensions, it is then possible in each case to provide a version with relatively low elasticity (relatively high hardness) and relatively high elasticity (relatively low hardness). For the provision of the uneven supporting surface, use is then correspondingly made of four different types of elastic bodies, in particular cuboids, namely

- relatively hard bodies, in particular cuboids with relatively small dimensions
- relatively hard bodies, in particular cuboids with relatively large dimensions
- relatively soft bodies, in particular cuboids with relatively small dimensions
- relatively soft bodies, in particular cuboids with relatively large dimensions.

The supporting surface is then formed from said four types of elastic bodies (cuboids).

In principle, according to the invention, the feature of an uneven supporting surface is fulfilled if at least one elastic elevation or an elastic portion/region differs from the rest of the elevations/portions/regions, in particular differs in terms of height. However, the corresponding unevennesses are generally intended to be distributed over the entire supporting surface. In principle, this can be achieved by distributing the elevations, in particular the arrangement of elastic bodies with different dimensions, in a regular pattern over the entire supporting surface. Said regular pattern may be predefined, and then results in a corresponding arrangement of the elevations or in a regular arrangement of the elastic bodies on which the corresponding elevations are located.

In this context, however, it is preferable according to the invention for the "unevenness" of the supporting surface to not follow any determined (predefined) pattern. Rather, in preferred embodiments of the mattress according to the invention, the elastic elevations, and thus in particular also the elastic bodies, are distributed in an irregular manner, that is to say without a predefined pattern, over the supporting surface. This is in line with the image used in the introduction that the mattress according to the invention should give the user the feeling of resting or sleeping on a (soft) forest floor. Although such a forest floor (like the mattress according to the invention) is ultimately uneven, said unevennesses are (also) not distributed in a regular pattern over the supporting surface for the user.

This aspect will also be explained later in conjunction with the example according to the invention.

As has already been briefly described, there are fundamentally various possibilities for providing the multiplicity of elastic elevations in the layer of the mattress according to the invention. For instance, it is for example possible for the elastic elevations to be formed in a mechanical manner from a block-like layer, in particular from a corresponding foam plastic block, for example by way of corresponding cutting. It is also possible for individual elastic bodies with the elastic elevations as partial portions/partial regions to be placed alongside one another in order to form an uneven supporting surface. The required form-fitting and/or forcefitting connection of the individual bodies can then be achieved for example by way of adhesive bonding or by way of bracing in an outer frame.

According to the invention, however, it is preferable for the individual elastic bodies with the elastic elevations formed thereon to be inserted into the openings (meshes) of a planar grid. In this way, on the one hand, a closed connection between the individual elastic bodies is provided and, on the other hand, a ventilation function can be provided by way of the corresponding construction of the grid. By way of example, this additional aspect of the invention is explained in more detail in the applicant's document EP-A1-2781209, which in this respect is incorporated into the content of this description by reference.

The cross-sectional area defined by the dimensions a and b of the cuboidal or cube-shaped elastic bodies is in this case slightly larger than the mesh width of the grid, with the result that reliable clamping of the elastic bodies in the grid is ensured. On the other hand, (small) cavities are produced between adjacent elastic bodies, said cavities ensuring uniform internal ventilation and making it possible to dissipate moisture and heat.

As has already been described, according to the invention, the elastic elevations and in particular also the elastic bodies are preferably composed of foam plastic. To determine the relative firmness of foams (hardness/softness), various parameters such as the volume weight (also called density) or the compression hardness can be used. The volume weight (density) is given in $kg/m^3$ and indicates the weight of a foam block with an edge length of 1 m. The compression hardness is given in kPa. Said compression hardness states how much pressure needs to act on a foam in order to compress it to a certain percentage of its starting height.

In the invention, it is preferable for the foam plastic used to have a compression hardness (at 40%) of ≤20 kPa, in particular a compression hardness (at 40%) of ≤10 kPa.

Preferred bulk densities of the foam plastics which may be used according to the invention lie between 30 $kg/m^3$ and 80 $kg/m^3$, in particular between 40 $kg/m^3$ and 50 $kg/m^3$.

In one development, it is preferable according to the invention for the mattress to have at least one base below the at least one layer with the elastic elevations. Additional stability is imparted to the layer and thus to the mattress according to the invention by said at least one base.

The base is generally connected, in particular adhesively bonded, to the layer arranged above it. If the elastic elevations are located on elastic bodies, the lower side of said bodies (which faces away from the elastic elevations) can be connected, in particular adhesively bonded, to the base. Here, in preferred embodiments, it may be sufficient for said connection, in particular adhesive bond, to be provided only on the elastic bodies that are provided at the edges of the mattress.

The aforementioned base is preferably of single-layer configuration. Said base is preferably likewise composed of a foam plastic, as is also used for the elastic elevations themselves or the elastic bodies. In this case, the base can preferably be composed of a foam plastic with relatively low elasticity, as is used for the described elastic bodies with relatively great hardness.

Furthermore, the mattress according to the invention, which can fundamentally be manufactured in any desired size (for example also as seat cushions and the like), preferably has the dimensions of so-called standard mattresses. Common sizes for single beds are for example 100 cm×200 cm and 90 cm×200 cm. However, there are a multiplicity of further common mattress sizes which are readily known to the person skilled in the art and which generally lie between 60 cm×120 cm and 200 cm×200 cm.

The height of the mattress according to the invention also generally lies in particular in the range of the heights of standard mattresses, that is to say between 15 cm and 25 cm. The height of the mattress according to the invention is preferably between 15 cm and 20 cm. In this case, the layer with the multiplicity of elastic elevations in the mattress according to the invention can have a height between 5 cm and 10 cm, possibly with a base having a height between 5 cm and 15 cm, in particular between 8 cm and 13 cm.

As a rule, on account of the materials used, the mattress according to the invention is configured in such a way that it can be rolled up. This makes it easier to transport the mattress, for example.

As has already been explained, in the case of the mattress according to the invention, no further support on which the user of the mattress is then actually lying and able to rest is located above the layer with the multiplicity of elastic elevations. The advantageous action of the uneven supporting surface formed by the elastic elevations develops to the best possible extent if there is no further (intermediate layer) located between said uneven supporting surface and the user.

Correspondingly, the mattress according to the invention may in particular have only a (thin) cover which, on the one hand, protects the uneven supporting surface against soiling and wear and which, on the other hand, at least partially absorbs the moisture produced when resting or sleeping. Depending on the material used, such a thin cover may also have a heating and/or anti-allergic function.

According to a further aspect, the invention also comprises the layer which has hitherto been described in conjunction with the mattress according to the invention. Said layer correspondingly has a multiplicity of elastic elevations which together form at least one supporting surface. In this case, the elastic elevations are designed, or arranged, such that an uneven supporting surface is formed.

In one development, the layer according to the invention has at least two types of elastic elevations with different elasticity.

In addition, the preferred features described in conjunction with the mattress according to the invention may also be present in the layer according to the invention. This relates for example to the fact that the aforementioned elastic elevations are formed on elastic bodies, in particular individual elastic bodies.

Reference is hereby also expressly made to all of the features described in conjunction with the mattress according to the invention in conjunction with the layer according to the invention.

The described invention is associated with a whole series of advantages.

For example, the provision of the uneven supporting surface already gives the user of the mattress a completely novel rest and sleep sensation. Although the feeling of comfortably sinking into a mattress with an even supporting surface may be lacking at first, this feeling is quickly replaced by the impression that the mattress according to the invention gives a completely novel sensation of lying down that supports the body. Every movement on the mattress has a massaging and vitalizing effect.

This is further reinforced in the embodiments of the mattress according to the invention in which portions of differing hardness are additionally provided. The multiplicity of possibilities as to how the elevations, and in particular the elevations of differing hardness, are distributed on the supporting surface make it possible for the provided effects to be oriented in a targeted manner to specific groups of people, and even in a targeted manner to individual users.

Further features and advantages of the invention emerge from the following description of a preferred embodiment of the invention in conjunction with the drawings. In this case, the individual features of the invention can in each case be implemented on their own or in combination with one another. The following description serves merely for the further explanation of the invention, without restricting the invention to the disclosure content of said description and the drawings.

Figure 2:
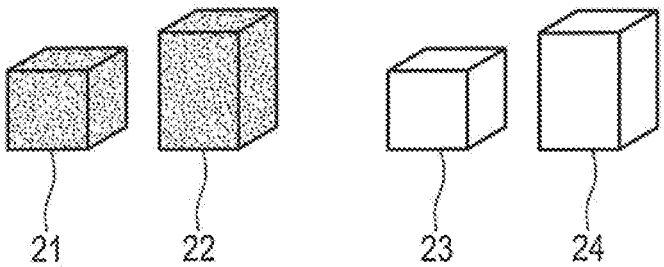
Figure 3:
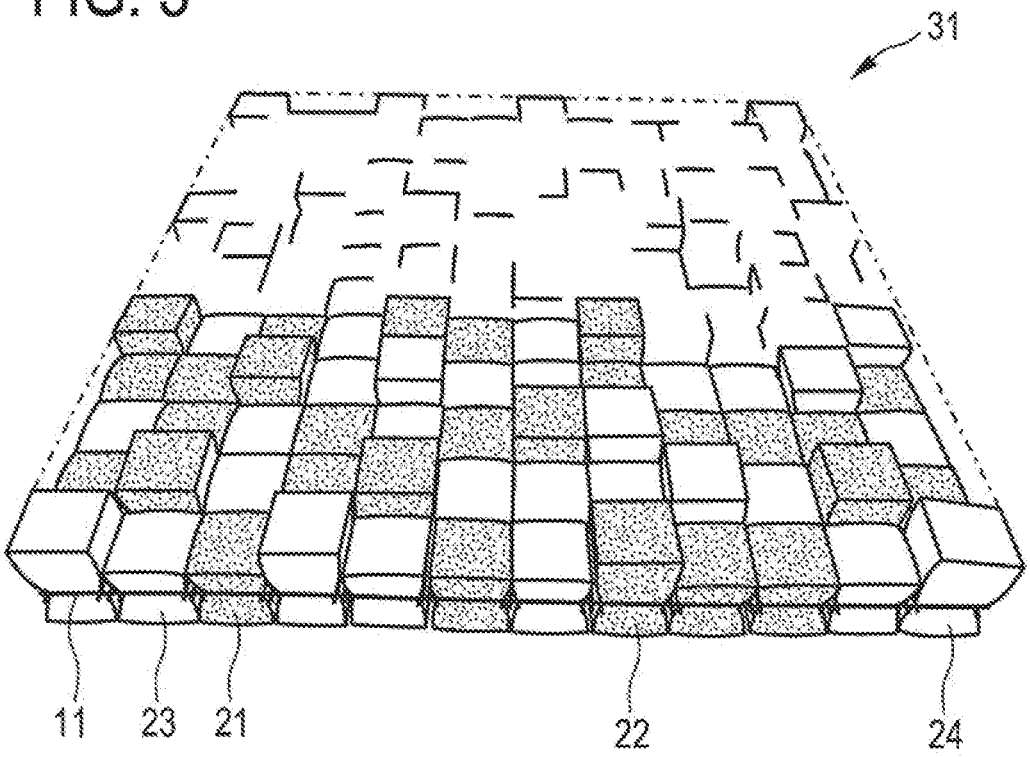
Figure 4:
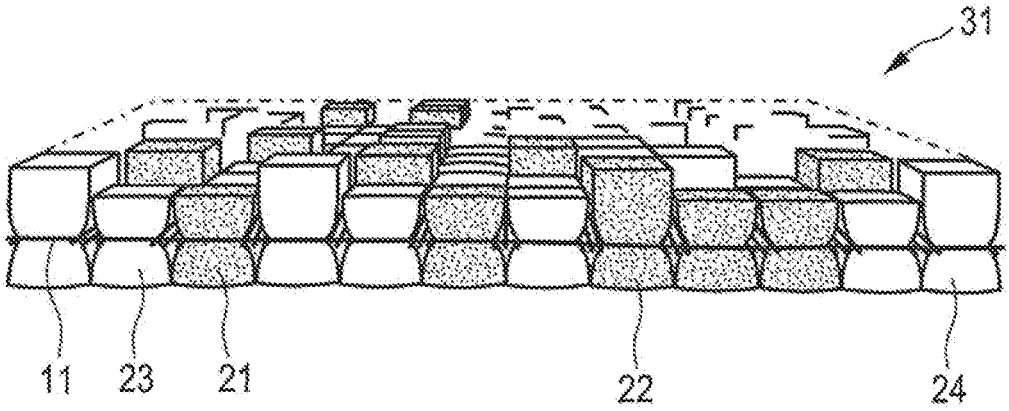
Figure 5:
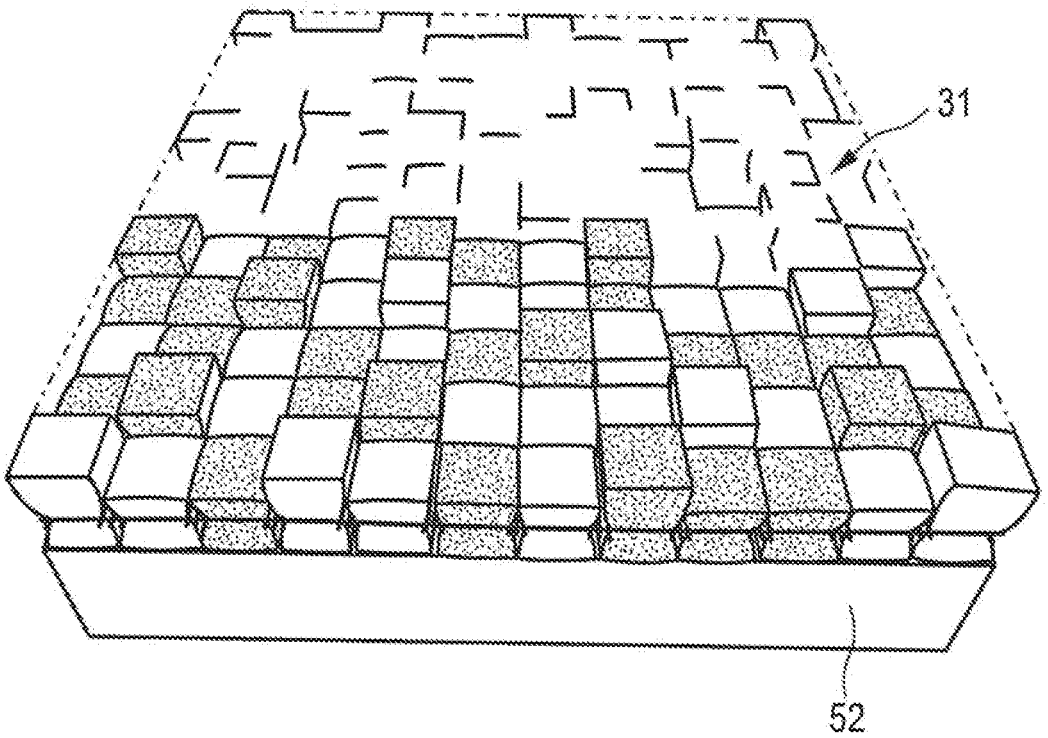
Figure 6:
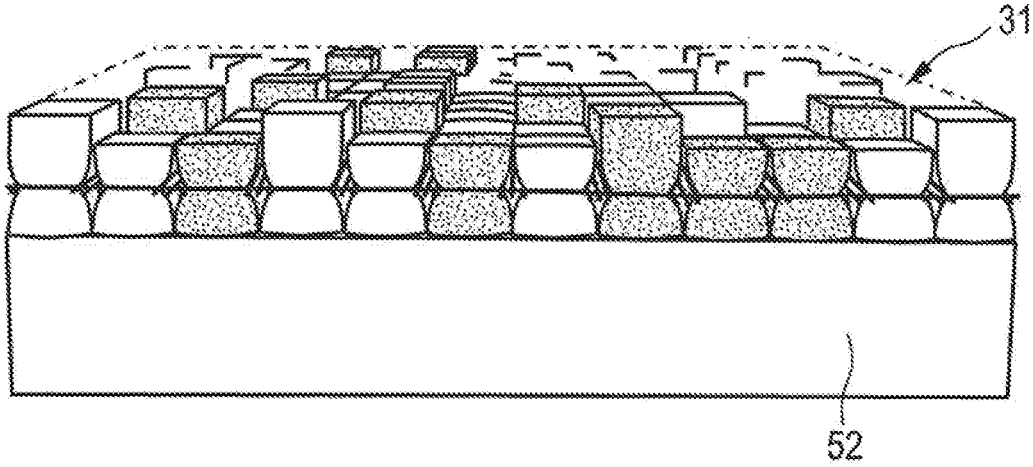
Figure 7:
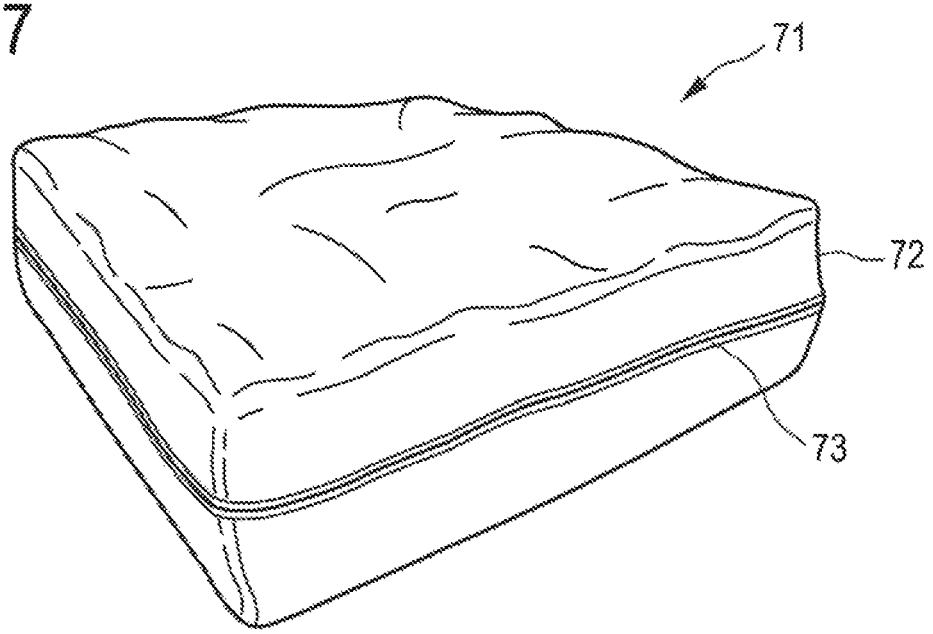
Figure 8:
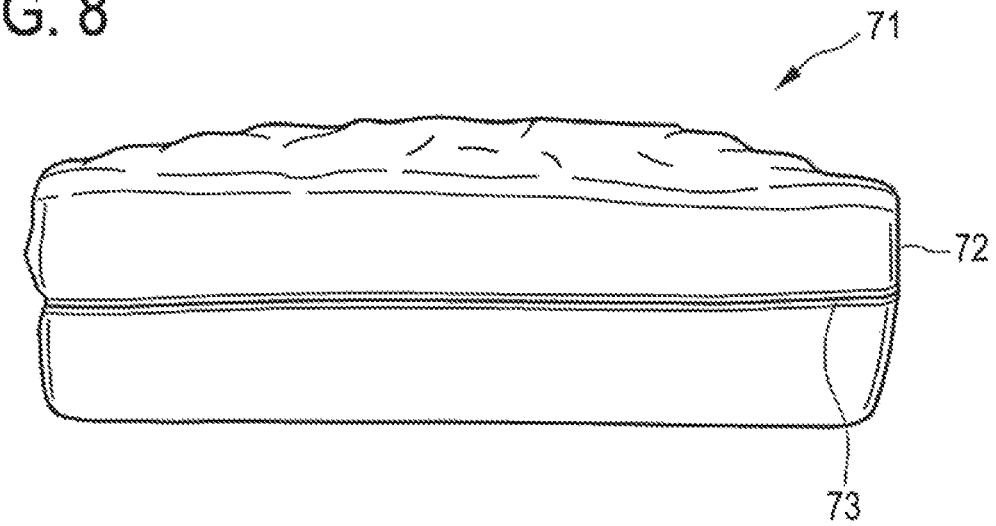

In the drawings:

FIG. 1: shows a grid which can be used for the production of a mattress according to the invention, FIG. 2: shows different elastic bodies on which elastic elevations for a mattress according to the invention are formed, FIG. 3: shows a schematic plan view of a layer according to the invention of a mattress according to the invention with a multiplicity of elastic elevations, FIG. 4: shows a schematic side view of the layer according to FIG. 3, FIG. 5: shows a schematic plan view of the layer as per FIG. 3 with an additionally provided base, FIG. 6: shows a schematic side view of the layer with a base as per FIG. 5, FIG. 7: shows a schematic plan view of a mattress according to the invention (including cover), and FIG. 8: shows a schematic side view of the mattress according to FIG. 7.

EXAMPLE

FIG. 1 shows a grid (11) with fibers (12) which are arranged in a longitudinal direction and in a transverse direction. Openings (13) are formed between the fibers which are in each case arranged in three rows. As will be explained later, said openings serve to receive elastic bodies.

In the example, said fibers are PVC-coated polyester fibers. The arrangement in each case in three rows serves to provide a ventilation effect for a layer according to the invention.

The dimensions of the grid (11) in the example are 60 cm×60 cm. For (full-body) mattresses having the above-mentioned sizes, correspondingly larger grids are used.

FIG. 2 shows four different elastic bodies 21, 22, 23 and 24 of cuboid shape which, by means of the grid (11), are used to produce a layer according to the invention and a mattress according to the invention.

The elastic bodies 21 to 24 are produced from polyurethane foam. In this case, the elastic bodies 21 and 22 are composed of a relatively hard foam, that is to say of a foam with relatively low elasticity, and the elastic bodies 23 and 24 are composed of a relatively soft foam, that is to say of a foam with relatively great elasticity.

Correspondingly, in the case of the example, the elastic bodies 21 and 22 can be composed of a polyurethane foam having a bulk density of 44 kg/m$^3$ and a compression hardness of 6.5 kPa, whereas the elastic bodies 23 and 24 can be composed of a polyurethane foam having a bulk density of 47 kg/m$^3$ and a compression hardness of 4.4 kPa. Here, the compression hardness is based in each case on a compression of 40%.

The elastic bodies 21 to 24 are used with the grid of the dimensions 60 cm×60 cm according to FIG. 1. The base area of said cuboidal elastic bodies is in each case 5 cm×5 cm. Said dimensions of the base area of the cuboids 21 to 24 are thus the same for all of the elastic bodies.

However, both the relatively hard cuboids 21 and 22 and the relatively soft cuboids 23 and 24 are provided in two different heights. In the case of the example, said heights are 6 cm (cuboids 21 and 23) and 8 cm (cuboids 22 and 24).

Correspondingly, a layer according to the invention and a mattress according to the invention can be provided by means of the elastic bodies 21 to 24, in the case of which layer and mattress the supporting surface is both uneven and has a different hardness at different points.

The elastic elevations of said layer and of said mattress are then provided by the elastic bodies 21 to 24, as will be explained in more detail below.

FIGS. 3 and 4 show a layer (31) according to the invention in a schematic plan view (FIG. 3) and in a schematic side view (FIG. 4).

As can be seen particularly well from FIG. 4, the elastic bodies 21 to 24 are inserted into the openings (13) of the grid (11), specifically so as to be flush on the lower side. This can be achieved in a simple manner by compressing and correspondingly arranging the elastic bodies in the grid. In this case, as can readily be seen both from FIG. 3 and from FIG. 4, an uneven supporting surface (not denoted in the figures), for example for the human body, which differs in terms of hardness at different points is provided on the upper side of the layer (31).

By specifying the number of different elastic bodies 21 to 24, and also by arranging them in the grid, it is possible to realize a multiplicity of very different layers with different supporting surfaces.

In the case of the example, it is for example possible to use 48 cuboids (21), 21 cuboids (22), 54 cuboids (23) and 21 cuboids (24), that is to say a total of 144 cuboids. Said cuboids are then inserted into the grid (11) in the distribution indicated in FIGS. 3 and 4. Using the same approach, a total of 720 (40×18) cuboids are then used for a standard mattress of 200 cm×90 cm, with a corresponding distribution in accordance with height and hardness.

As shown in FIGS. 3 and 4, the elastic elevations, which together form the supporting surface for the user of the mattress, are formed by/on the elastic bodies 21 to 24, in particular by the upper sides/upper regions of said elastic bodies. Here, characteristic features of the layer (31) according to the invention as per FIGS. 3 and 4 are, on the one hand, the unevenness of the supporting surface provided by the elastic bodies 21 to 24 and, on the other hand, the different hardness of said supporting surface at different points/regions.

FIGS. 5 and 6 show the case where the layer (31) according to the invention is arranged on a base (52). Said base (52) gives the layer (31) additional stability.

According to the example, the base (52) is likewise manufactured from a polyurethane foam. In this case, the base (52) is preferably formed by the same materials as are also used for the elastic bodies 21 to 24. In particular, the base (52) is likewise composed of a relatively hard foam like the cuboids 21 and 22.

As per FIGS. 5 and 6, the layer (31) can be connected to the base (52) in a suitable manner, in particular by adhesive bonding. Here, it is generally sufficient for the lower side of the peripheral cuboids of the layer (31) to be adhesively bonded (over the full area) to the base (52).

FIGS. 7 and 8 finally show the (finished) mattress (71) according to the invention with a cover (72). In this case, FIG. 7 illustrates a schematic plan view of the mattress (71), and FIG. 8 illustrates a schematic side view of said mattress (71). As illustrated, the cover (72) can be removed by means of the zip fastener (73). The following two aspects which have already been explained in conjunction with the invention are to be emphasized in conjunction with FIGS. 7 and 8.

On the one hand, both figures show that the upper side of the mattress, said upper side forming the supporting surface, is uneven. This important aspect distinguishes the mattress (71) according to the invention from hitherto known mattresses and supports. In addition, the supporting surface also has different hardnesses at different points, which represents a further important aspect of the invention.

On the other hand, the cover (72) which is present in FIGS. 7 and 8 has no significance for the function of the mattress (71). The cover does not form an additional support that could influence, in particular adversely affect, the actual function of the mattress in any way. The cover serves merely to protect the elastic bodies/elastic elevations that form the actual supporting surface.

In the example, the cover can have a thickness of (only) 3 mm with a weight per square meter (grammage) of 300 $g/m^2$.

The invention claimed is:

1. A mattress, comprising at least one layer, the at least one layer comprising:

a planar grid comprising a plurality of groups of fibers, the plurality of groups of fibers defining a plurality of first openings, wherein each group of the plurality of groups of fibers comprises three rows of fibers, and adjacent fibers in each group of the plurality of groups of fibers define a plurality of second openings for ventilation;

a plurality of elastic bodies inserted into the plurality of first openings, wherein the plurality of elastic bodies have bottom surfaces being coplanar with each other;

wherein the plurality of elastic bodies have upper surfaces thereon which together provide one uneven supporting surface, wherein the plurality of elastic bodies comprise at least two types of elastic bodies having different elasticity, and the plurality of elastic bodies have at least two types of dimensions for each type of elasticity, and wherein the plurality of elastic bodies are distributed in an irregular manner with respect to different elasticity and dimension so as to provide the uneven supporting surface.

2. The mattress as claimed in claim 1, wherein the plurality of elastic bodies are composed of foam plastic.

3. The mattress as claimed in claim 2, wherein the foam plastic has a compression hardness (at 40%) of ≤20 kPa.

4. The mattress as claimed in claim 2, wherein the foam plastic has a bulk density between 30 $kg/m^3$ and 80 $kg/m^3$.

5. The mattress of claim 2, wherein the foam plastic has a compression hardness (at 40%) ≤10 kPa.

6. The mattress of claim 2, wherein the foam plastic has a bulk density between 40 $kg/m^3$ and 50 $kg/m^3$.

7. The mattress as claimed in claim 1, wherein the at least two types of dimensions are different height.

8. The mattress as claimed in claim 1, wherein the plurality of elastic bodies have a shape of a polyhedron.

9. The mattress as claimed in claim 8, wherein the plurality of elastic bodies have dimensions ≤20 cm.

10. The mattress as claimed in claim 9, each of the plurality of elastic bodies is of cuboid shape, having a length or width between 5 cm and 7 cm, and a height between 3 cm and 8 cm.

11. The mattress as claimed in claim 1, wherein at least one base is arranged below the at least one layer, wherein said base is composed of at least one foam plastic.

12. The mattress of claim 1, wherein the plurality of elastic bodies are composed of at least one polyurethane foam.

13. The mattress as claimed in claim 1, wherein the plurality of elastic bodies have a shape of a cuboid or of a cube.

14. The mattress as claimed in claim 13, wherein the plurality of elastic bodies have dimensions between 2 cm and 10 cm.

15. The mattress as claimed in claim 1, wherein the plurality of groups of fibers are polyvinyl chloride (PVC) coated polyester fibers.

16. The mattress as claimed in claim 1, wherein the plurality of groups of fibers are polyvinyl chloride (PVC) coated polyester fibers.

17. An article having one layer configured to be a part of a mattress, the one layer comprising:

a planar grid comprising a plurality of groups of fibers, the plurality of groups of fibers defining a plurality of first openings, wherein each group of the plurality of groups of fibers comprises three rows of fibers, an adjacent fibers in each group of the plurality of groups of fibers define a plurality of second opening for ventilation;

a plurality of elastic bodies inserted into the plurality of first openings, wherein the plurality of elastic bodies have bottom surface being coplanar with each other;

wherein the plurality of elastic bodies have upper surfaces thereon which together provide one uneven supporting surface, wherein the plurality of elastic bodies comprises at least two types of elastic bodies having different elasticity, and the plurality of elastic bodies have at least two types of dimensions for each type of elasticity, and wherein the plurality of elastic bodies are distributed in an irregular manner with respect to different elasticity and dimension so as to provide the uneven supporting surface.

* * * * *